United States Patent [19]

Liu et al.

[11] 4,253,872

[45] Mar. 3, 1981

[54] THORIUM DOPED IRIDIUM ALLOY FOR RADIOISOTOPE HEAT SOURCES

[75] Inventors: Chain-Tsuan Liu; Henry Inouye; Anthony C. Schaffhauser, all of Oak Ridge; Calvin L. White, Powell, all of Tenn.

[73] Assignee: The United States of America as represented by the United States Department of Energy, Washington, D.C.

[21] Appl. No.: 769,124

[22] Filed: Feb. 16, 1977

[51] Int. Cl.[3] ..... C22C 5/04

[52] U.S. Cl. ..... 75/172 R

[58] Field of Search ..... 75/172 R, 172 E; 136/202; 176/91 R

[56] References Cited

U.S. PATENT DOCUMENTS

| | | | |
|---|---|---|---|
| 3,262,779 | 7/1966 | Price et al. | 75/172 R |
| 3,293,031 | 12/1966 | Rhys et al. | 75/172 R |
| 3,970,450 | 7/1976 | Liu et al. | 75/172 R |

FOREIGN PATENT DOCUMENTS

| | | | |
|---|---|---|---|
| 449371 | 6/1948 | Canada | 75/172 R |
| 823521 | 10/1951 | Fed. Rep. of Germany | 75/172 R |
| 839719 | 4/1952 | Fed. Rep. of Germany | 75/172 R |
| D 20355 | 9/1956 | Fed. Rep. of Germany | 75/172 R |
| 594837 | 11/1947 | United Kingdom | 75/172 R |
| 1139897 | 1/1969 | United Kingdom | 75/172 R |

*Primary Examiner*—Michael L. Lewis

*Attorney, Agent, or Firm*—Allen H. Uzzell; Stephen D. Hamel; James E. Denny

[57] ABSTRACT

A novel iridium alloy containing 100–500 ppm thorium has enhanced impact properties over undoped iridium and over prior art iridium alloys.

8 Claims, 2 Drawing Figures

THORIUM DOPED IRIDIUM ALLOY FOR RADIOISOTOPE HEAT SOURCES

BACKGROUND OF THE INVENTION

This invention was made in the course of, or under, a contract with the United States Energy Research and Development Administration. It relates generally to a novel iridium base alloy composition and particularly to an alloy suited for use as an encapsulation material for radioisotope fuels. Radioisotope fuels have found considerable use as both terrestrial and space power sources. Such fuels utilize an isotope which is an alpha, beta, or gamma emitter. Heat is produced from these nuclear emissions and converted into electrical energy by means of thermoelectric generators or thermionic or dynamic converters.

The most prominent radioisotope fuels at present are $^{238}PuO_2$ and $^{244}Cm_2O_3$. These particular isotopes in the oxide form are desirable because of their refractory properties. The $^{238}PuO_2$ and $^{244}Cm_2O_3$ are generally sintered into spherical balls or cylindrical pellets.

Radioisotopic fuels which are used in space power systems must be encapsulated in a highly reliable material, not only to contain the fuel for normal operation for several years, but to survive launch abort situations, severe aerodynamic heating on re-entry and high velocity impact after years of high temperature service. Various alloys have been developed for use as an encapsulation material in this type of environment. See for example commonly assigned U.S. Pat. Nos. 3,737,309, 3,918,965 and 3,970,450. The most prominent encapsulation alloys have been iridium or iridium-tungsten, each sometimes containing ppm levels of various dopants.

Of particular recent interest has been the alloy described in commonly assigned U.S. Pat. No. 3,970,450. This alloy comprises an iridium matrix containing 20–50 ppm aluminum, 20–100 ppm iron, 5–20 ppm nickel, 50–100 ppm rhodium and 15–50 ppm thorium, and in some cases 0.3 wt. % tungsten. While this alloy exhibits higher tensile strength, greater impact elongation and a lesser tendency for grain growth than unalloyed Ir or Ir-0.3% W, its impact resistance drops considerably at temperatures below about 1250° C., and its ductility is significantly reduced after exposure to high temperatures for extended periods. For space nuclear power systems it is very important that fuel encapsulation materials be resistant to long term high temperature conditions, e.g., 1330° C. for several years, as well as brief excursions at higher temperatures, e.g., 1800° C., without excessive loss of impact properties.

SUMMARY OF THE INVENTION

It is an object of this invention to provide a iridium-based alloy having improved impact properties over un-alloyed iridium and prior art iridium alloys.

It is a further object to provide an alloy with enhanced impact resistance after long term exposure to high temperatures.

It is a further object to provide an alloy with enhanced impact properties at lower temperatures.

It is a further object to provide an alloy with enhanced resistance to grain growth.

These and other objects are accomplished according to this invention in an iridium base alloy composition having enhanced impact resistance comprising by weight 100–500 ppm thorium and iridium as balance.

The alloy can also contain other metals such as 0.2 to 2 wt. % tungsten.

DESCRIPTION OF THE PREFERRED EMBODIMENT

Figure 1:
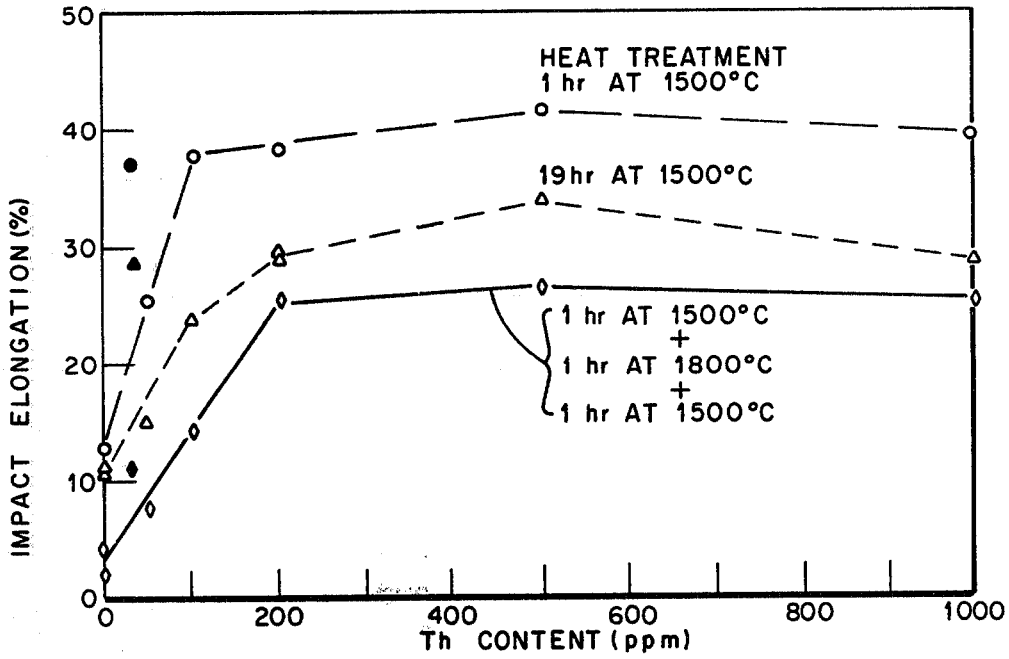
FIG. 1 is a graph of impact elongation versus thorium content for alloys undergoing different heat treatments.

It has been found according to this invention that dopant levels of thorium alone can significantly enhance the impact properties of iridium-based alloys. Iridium-based alloys containing 100–500 ppm thorium have substantially improved impact resistance over undoped alloys and alloys doped with nickel, iron, rhodium and smaller amounts of thorium. The alloy of this invention is more resistant to grain growth during long term exposure to high temperature and has substantially greater impact elongation at temperatures below 1250° C.

Microanalytical studies indicate that the thorium added at ppm levels in the subject alloys segregates substantially on grain boundaries and thereby strengthens the boundaries and suppresses the brittle fracture associated with the grain-boundary separation. Optical microscopy has revealed the presence of a precipitated second phase, probably $ThIr_5$ particles which retard grain growth during heat treatment. This would tend to cause the alloy to retain its impact resistance over long periods at elevated temperatures.

Tensile tests at slow strain rates indicate that the yield strength and tensile strength of iridium-based alloys increases continuously with thorium content. The ductility as indicated by the percent elongation also increases linearly with Th content up to about 200 ppm after which it remains essentially constant to 500 ppm Th. Above 500 ppm, the tensile ductility decreases with additional thorium content. It is likely that the observed loss of ductility is due to precipitated particles forming stringers at the grain boundaries, thereby promoting fracture by grain boundary separation.

The alloys of this invention demonstrate enhanced impact properties over the entire 100–500 ppm range of thorium concentration. The most desirable fracture behavior of the system (least grain boundary separation and most transgranular fracture) occurs at the level of about 100–200 ppm Th. Maximum elongation is obtained at above 200 up to 500 ppm Th. Some applications might require that the thorium concentration be kept at levels below 100 ppm, for example to improve weldability. Since at lower ppm levels, tensile strength, yield strength, and ductility increase continuously with Th content, a measure of improvement over the prior art can be obtained in the 50–100 ppm range, without departing from the concept of this invention.

The iridium-based alloy of this invention containing 100–500 ppm thorium can also contain 0.2–2 wt. % or more preferably 0.2–0.4 wt. % tungsten for further improving its strength and fabricability. Of course, the alloy of this invention can contain other metallic elements as minor constituents or as impurities without departing from the intended scope of this invention. Of particular interest for space nuclear power systems are alloys consisting essentially of iridium and 100–500 ppm thorium and of iridium 0.3 wt. % tungsten, 100–500 ppm thorium.

The effect of thorium concentration on the mechanical properties of iridium-based alloys is demonstrated in the tables. The alloy composition of U.S. Pat. No. 3,970,450 is included for comparison. For Table 1, the alloy specimens were annealed 1 hour at 1500° C. before testing and were tensile tested at 650° C. at a crosshead speed of 2.54 mm/min in vacuum. For the fracture mode columns, GBS=grain boundary separation, TF=transgranular fracture, DR=ductile rupture, Ma=major fraction and Mi=minor fraction.

TABLE I

Tensile Properties of Doped and Undoped Ir-0.3%W Sheet Specimens

| Nominal Dopant Concentration (wt.ppm) | Strength (psi) Yield | Tensile | Elongation (%) | Fracture Mode |
|---|---|---|---|---|
| None | 7,400 | 70,800 | 30.1 | Mainly GBS |
| 50 Th | 10,500 | 77,700 | 39.2 | GSB(Ma) and TF(Mi) |
| 100 Th | 11,300 | 80,000 | 38.5 | Mainly TF |
| 200 Th | 14,000 | 88,000 | 41.5 | Mainly TF |
| 500 Th | 17,600 | 97,600 | 36.7 | TF(Ma) and GBS(Mi) |
| 1000 Th | 18,300 | 86,300 | 27.0 | TF(Mi) and GBS(Ma) |
| 30 Th, 40 Al, 80 Fe, 16 Ni, 75 Rh | 15,200 | 82,400 | 37.1 | Mainly TF |

Table 2 demonstrates the effects of heat treatment on the impact properties of the alloys as compared to undoped Ir-0.3% W and the alloy of U.S. Pat. No. 3,970,450. The impact tests were carried out at 1350° C. and 85 m/sec. The grain size is measured as the number of grains across a 0.64 mm sheet.

TABLE II

Effects of Heat Treatment on Tensile Impact Properties Doped and Undoped Ir-0.3%W Alloys

| Nominal Dopant Concentration (ppm) | Grain Size | Elongation (%) | Reduction of Area (%) | Fracture Mode |
|---|---|---|---|---|
| Annealed 1 hr. at 1500° C. | | | | |
| None | 10.7 | 12.6 | 28 | Mainly GBS |
| 50 Th | 20.9 | 25.5 | 89 | DR |
| 100 Th | 19.3 | 38.2 | 87 | DR |
| 200 Th | 25.3 | 37.9 | 92 | DR |
| 1000 Th | 27.3 | 39.4 | 87 | DR |
| 40 Al, 80 Fe, 30 Th 16 Ni, 75 Rh | 19.2 | 37.6 | 94 | DR |
| Annealed 19 hrs. at 1500° C. | | | | |
| None | 5.8 | 10.5 | 24 | Mainly GBS |
| 100 Th | 10.8 | 23.8 | 50 | TF |
| 200 Th | 15.0 | 28.9 | 84 | DR |
| 200 Th | 15.0 | 29.1 | 90 | DR |
| 1000 Th | 21.8 | 29.0 | 87 | DR |
| 40 Al, 80 Fe, 30 Th, 16 Ni, 75 Rh | 9.9 | 28.6 | 60 | TF and DR |
| Annealed 1 hr. at 1500° C. + 1 hr. at 1800° C. + 1 hr. at 1500° C. | | | | |
| None | 2.4 | 2.2 | 7 | Completely GBS |
| None | 2.4 | 4.6 | 5 | Completely GBS |
| 100 Th | 6.5 | 14.1 | 27 | Mainly GBS |
| 200 Th | 12.0 | 25.2 | 71 | DR and TF |
| 1000 Th | 14.9 | 25.4 | 73 | DR and TF |
| 40 Al, 80 Fe, 30 Th, 16 Ni, 75 Rh | 3.8 | 11.0 | 19 | Mainly GBS |

It can be readily seen that the alloys having in excess of 100 ppm thorium are substantially more resistant to grain growth, particularly at 1800° C. than are either the undoped alloy or the alloy of U.S. Pat. No. 3,970,450. The relationship of impact elongation to thorium content after heat treatment is graphically depicted in FIG. 1. All of the samples were impacted at 1350° C. at a velocity of 85 m/sec. The unconnected points (filled symbols) at 30 ppm Th represent Ir-0.3% W containing (ppm) 40 Al, 80 Fe, 30 Th, 16 Ni, and 75 Rh (U.S. Pat. No. 3,970,450). The greatest enhancement over the 3,970,450 alloy is seen in the resistance to the 1800° C. temperature.

The impact properties of the iridium-based alloys of this invention are directly related to grain size in that an alloy of the same composition having a smaller grain size demonstrates improved impact resistance. It is therefore particularly important for space excursions of long duration that isotopic fuel encapsulation alloys be resistant to grain growth. The impact properties must be retained during exposure to high temperatures to prevent failure upon re-entry and impact. The impact properties of the alloys of this invention and the U.S. Pat. No. 3,970,450 alloys are sensitive to grain size but the higher impact resistance obtainable in the subject alloys is retained over longer periods of exposure to elevated temperatures.

Figure 2:
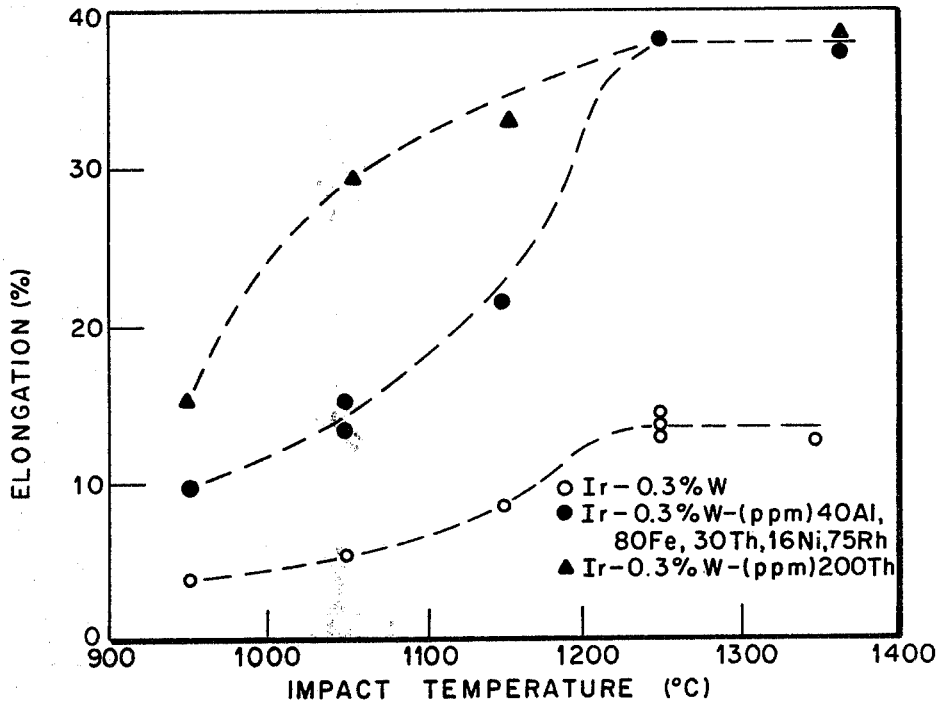
FIG. 2 is a graph of impact elongation versus temperature of impact for an alloy of this invention and for other alloys.

Another advantage of the thorium doped alloys of this invention is their high impact resistance over a broader temperature range than either undoped alloys or alloys doped according to U.S. Pat. No. 3,970,450. This is graphically depicted in FIG. 2. The impact specimens were annealed for 1 hr. at 1500° C. prior to impact testing at 85 m/sec. It is seen that the alloy of this invention and the alloy of U.S. Pat. No. 3,970,450 possess substantially the same impact elongation above 1250° C., but the alloy doped according to this invention demonstrates up to twice the impact elongation at temperatures below 1250° C.

The doped alloy of this invention is best prepared by arc melting the appropriate metal powders or by melting an Ir-Th master alloy of precisely known concentration in combination with appropriate amounts of Ir-W alloy. Electron beam melting may also be used. Once an ingot is prepared by arc melting, the preferred method of fabricating sheet from the ingot is to hot roll the ingot between 900° and 1200° C.

The following example is presented as a method for preparing test specimens (or sheet) according to this invention, having the desired Th dopant concentration.

EXAMPLE

An Ir-0.3% W alloy containing 200 ppm Th was prepared by arc melting and drop cast into a 1.9×1.9×2.9 cm. ingot weighing about 400 g. The starting material was Ir-0.3% W alloy chips and an Ir-2% Th master alloy. The alloy ingot was then clad in a molybdenum jacket and hot rolled at 1200° C. with 25% reduction per pass. Afer a final reduction of 65%, the alloy plate was recrystallized by heat treatment for 1 hour at 1300° C. Continued rolling to 0.8 mm thick sheet was accomplished at 900°-1100° C. The alloy sheet so fabricated had good quality with no indication or surface of end cracks. Table III shows the chemical composition of this alloy, analyzed by spark-source-mass spectrographic methods. Test specimens were machined or blanked from the sheet stock.

TABLE III

CHEMICAL ANALYSIS OF IR-0.3% W ALLOY DOPED WITH 200 PPM TH

| Element | Content (ppm) | Element | Content (ppm) | Element | Content (ppm) |
|---|---|---|---|---|---|
| Ag | <1 | Mo | 10 | Ru | 100 |
| Al | 1 | Ni | 1 | Si | 1 |
| Ca | ≦0.1 | P | <0.5 | Ta | 5 |
| Cr | 1 | Pd | <1 | Th | 200 |
| Cu | 10 | Pt | 50 | Ti | <3 |

TABLE III-continued

CHEMICAL ANALYSIS OF IR-0.3% W ALLOY DOPED WITH 200 PPM TH

| Element | Content (ppm) | Element | Content (ppm) | Element | Content (ppm) |
|---|---|---|---|---|---|
| Fe | 5 | Rh | 10 | W | 2900 |

Based upon microanalytical studies, the thorium is thought to improve the Ir alloys by two mechanisms. The thorium added at ppm levels in the alloy segregates substantially on grain boundaries at a level of 3–5 at. %, thereby strengthening the boundaries and suppressing the brittle fracture mode of grain boundary separation. In addition, a part of the thorium added reacts with base Ir to form $ThIr_5$ particles in the alloy. The precipitation of stable $ThIr_5$ particles effectively retard grain growth during heat treatments. While the test date presented herein was based on Ir-0.3 wt. % W alloys, it can be readily seen that the 100–500 ppm concentration of thorium is effective for preventing grain growth in iridium and a variety of iridium-based alloys containing small amounts of other metals.

What is claimed is:

1. An iridium base alloy composition having enhanced impact resistance consisting essentially of by weight 100–500 ppm thorium and the balance selected from the group of (a) iridium and (b) iridium and 0.2–2% tungsten.

2. The alloy according to claim 1 consisting essentially of 100–500 ppm thorium, 0.2–2% tungsten, and iridium as the balance.

3. The alloy of claim 1, consisting essentially by weight of 100–500 ppm thorium and iridium as the balance.

4. The alloy of claim 1, consisting essentially of 100–500 ppm thorium, 0.3% tungsten, and iridium as the balance.

5. The alloy of claim 1 comprising by weight 100–200 ppm thorium.

6. The alloy of claim 1 comprising by weight 200–500 ppm thorium.

7. The alloy of claim 2 comprising by weight 100–200 ppm thorium.

8. The alloy of claim 2 comprising by weight 200–500 ppm thorium.

* * * * *